US005823582A

United States Patent [19]

Frolov et al.

[11] Patent Number: 5,823,582

[45] Date of Patent: Oct. 20, 1998

[54] ELECTROMAGNETICALLY-MANAGED LATCHING EXIT BAR

[75] Inventors: George Frolov, Farmington; John E. Walsh, III, Bristol; James J. Scott, New Britain, all of Conn.

[73] Assignee: Harrow Products, Inc., Grand Rapids, Mich.

[21] Appl. No.: 518,759

[22] Filed: Aug. 24, 1995

[51] Int. Cl.[6] ..... E05B 65/10; E05C 17/56; H01F 7/00; H01H 3/16

[52] U.S. Cl. ..... 292/92; 292/251.5; 292/21

[58] Field of Search ..... 70/92; 200/61.62–61.68; 292/92, 201, 251.5, DIG. 65; 340/541, 545, 825.3–825.35

[56] References Cited

U.S. PATENT DOCUMENTS

| | | | |
|---|---|---|---|
| Re. 35,268 | 6/1996 | Frolov et al. | 340/545 |
| 3,873,141 | 3/1975 | Peterson | 292/92 X |
| 4,006,471 | 2/1977 | Pappas | 70/92 X |
| 4,314,722 | 2/1982 | Logan, Jr. | 292/92 X |
| 4,328,985 | 5/1982 | Logan | 292/201 |
| 4,344,647 | 8/1982 | Van Der Linden | 292/201 |
| 4,351,552 | 9/1982 | Van Der Linden | 292/201 |
| 4,545,606 | 10/1985 | Vodra | 292/92 |
| 4,763,937 | 8/1988 | Sittnick, Jr. et al. | 292/251.5 |
| 4,893,852 | 1/1990 | Harris et al. | 292/251.5 |
| 4,961,330 | 10/1990 | Evans | 292/92 X |
| 5,065,136 | 11/1991 | Frolov et al. | 340/565 |
| 5,340,171 | 8/1994 | Slaybuagh et al. | 292/92 X |
| 5,412,961 | 5/1995 | Cain et al. | 70/92 |

*Primary Examiner*—J. R. Scott
*Attorney, Agent, or Firm*—Alix, Yale & Ristas, LLP

[57] ABSTRACT

An exit bar for securing a door has a housing adapted for mounting to a door. A push pad for receiving a push force is mounted to the housing. A latch extends from the housing to releasably latch the door to which the exit bar is mounted. A link system links the push pad to the latch so that a push force exerted on the push pad releases the latch. An electromagnetic lock disposed in the housing locks the link system to prevent releasing of the latch. The electromagnetic lock employs an electromagnet and a movable armature to lock the link system. The exit bar further delays unlocking the link system for a preestablished delay time after the push pad has been pushed.

34 Claims, 9 Drawing Sheets

ELECTROMAGNETICALLY-MANAGED LATCHING EXIT BAR

BACKGROUND OF THE INVENTION

This invention relates to the field of door security systems. More specifically, this invention relates to the use of a push or exit bar for securing a doorway.

Push bars or exit bars which allow egress through a doorway while limiting ingress are well-known components of door security and emergency systems. The conventional exit bar is mounted on the interior side of the door to be secured and is oriented generally horizontally across the face of the door. A push force on the bar toward the door face operates a door latch to permit opening of the door. Conventional exit bars typically employ a mechanical linkage to actuate the latch mechanism for unlatching the door. Exit bars may also employ mechanical locks to secure the door from opening. A handle can be additionally provided on the exterior face of the door to allow ingress under certain circumstances. Exit bars have also been connected with alarm systems to warn security personnel of a door opening.

Conventional exit bar systems while enjoying great popularity have also exhibited a number of deficiencies. For example, to secure an exit bar from operating the associated latch may require individually manually locking each bar. For most applications, it is generally undesirable for safety reasons to permanently lock exit bars. Even when a building has low occupancy, there may be times when for emergency reasons, exit doors should not be secured in a permanent fashion that would inhibit egress.

During periods of high traffic levels through a doorway, mechanical latch mechanisms of a conventional exit bar can experience a high rate of wear. To reduce wear on mechanical latch components, some conventional exit bars may be manually locked in a dogged position wherein the latches remain in a retracted state. However, each bar must be directly manually dogged and undogged at the site of the door.

Similar problems arise with regard to exit bar systems that employ an auxiliary outside handle to allow selective ingress to a secured area. The operative mode of these outside handles must be generally individually manually changed by visiting the exit bar installation to set the desired mode.

In more advanced systems, alarms have been connected to exit bars to generate audible or visible indications when an egress is attempted. These alarms are generally not sophisticated in distinguishing between permitted and unpermitted egresses. In health care facilities, alarms may also be used to indicate attempts by patients to egress the facility. Such alarms are particularly important in facilities where patients may need monitoring or assistance in egressing. For example, in facilities caring for patients lacking full mental or physical competence, such as nursing homes or child care facilities, egress for some individuals should be prevented in other than emergency situations. However, a deficiency of many conventional exit bars is to allow immediate egress even when the exit bar is combined with an alarm. This may permit unauthorized personnel or patients to immediately exit a secured area.

Attempts have been made to combine exit bars with various forms of door locking and security systems to overcome some of the above-mentioned problems. Such hybrid systems, however, tend to result in excessive costs and complexity. Such combination lock systems may require mounting not only the exit bar, but also mounting an auxiliary lock system to the secured door.

SUMMARY OF THE INVENTION

Briefly stated, the invention in a preferred form is an electromagnetically secured exit bar for mounting to a door. The exit bar employs a mechanically actuated latch. The latch may be unlatched by a force applied to a push pad on the front of the exit bar. Located within the exit bar is a selectively, electrically actuated locking mechanism. The locking mechanism employs an electromagnet and a moveable armature to lock the exit bar latch and therefore secure the door.

In a preferred form of the invention, the mounting structure for the electromagnet armature is configured in such a manner as to allow an initial limited movement of the push pad before unlatching the door.

This initial movement triggers an electric switch mechanism to initiate an alarm, implement instantaneous unlocking from inside, begin a delayed unlocking sequence or initiate other security measures. In one preferred form, a delay unlocking sequence commences at the time of initial contact on the push pad. At the end of a preestablished delay period, the exit bar unlocks thereby allowing further displacement of the push pad to unlatch the door. The preestablished delay period in unlocking the exit bar allows time for security personnel to arrive at the site of the door or otherwise respond if required to assist or prevent egress.

The electromagnetically secured exit bar further provides selective, permanent unlatching, or dogging, of the latch mechanism during times of high traffic use of a doorway. The dogging of the latch mechanism allows the door to be transformed to a push-pull mode for free ingress and egress. In addition, the user's hands are free for other tasks. The dogging may also reduce wear on the lock mechanism due to repetitive latching and unlatching, and also speeds the user's passage through the door.

In locations where ingress through the doorway is desired, a handle may be provided at the exterior side of the door. A fixed handle may be employed to allow ingress for applications where the exit bar is dogged. The handle may also be configured to actuate the latch through an unlocking mechanism similar to that employed in conjunction with the push pad. The unlocking mechanism secures the door from immediate access, which can be granted by electrical access control systems like a keyswitch or more sophisticated systems which employ card readers, keypads, touch keys, etc.

The exit bar may be further integrated into an overall security system employing readers, touch pads, electronic keys or other personnel identification security measures. Such security systems readily interface with the electromagnetic lock system to control both ingress and egress through the door. For example, a reader could be provided at the exterior side of the door. The exit bar of the invention could be controlled so as not to allow ingress until a valid code has been entered into the reader. The exit bar could be further controlled to allow immediate egress without delay when the valid code is entered into a reader at the interior side of the door. An attempted egress without use of a valid code would initiate the delayed unlocking system and actuate an alarm.

Furthermore, the invention may be combined with other alarms at the location of the door or at a remote location to signify attempted egress or ingress. In another preferred form of the invention, the exit bar of the invention may be placed in various latched, unlatched, locked and unlocked modes from a remote location such as a central security console. The exit bar of the invention can also be efficiently integrated into a fire alarm system. The exit bar for such an application provides an important failsafe feature. Should power be interrupted during an emergency situation, the locking electromagnet releases allowing immediate egress and ingress through the doorway. If the exit bar is in the dogged mode when power is interrupted, the exit bar returns to the undogged latched state.

An object of the invention is to provide a new and improved exit bar that may be efficiently and reliably controlled from a remote location.

Another object of the invention is to provide an exit bar having a delayed unlocking system to allow security or hospital personnel time to respond to the site of the secured door.

A yet another object of the invention is to provide an exit bar capable of multiple optional operating modes.

A further object of the invention is to provide an exit bar that may be easily and efficiently employed in conjunction with other security or fire alarm systems.

A yet further object of the invention is to provide an exit bar that can be efficiently dogged in an unlatched position during times of high usage.

Other objects and advantages of the invention will become apparent from the drawings and the specification.

DETAILED DESCRIPTION OF THE PREFERRED EMBODIMENTS

Figure 1:
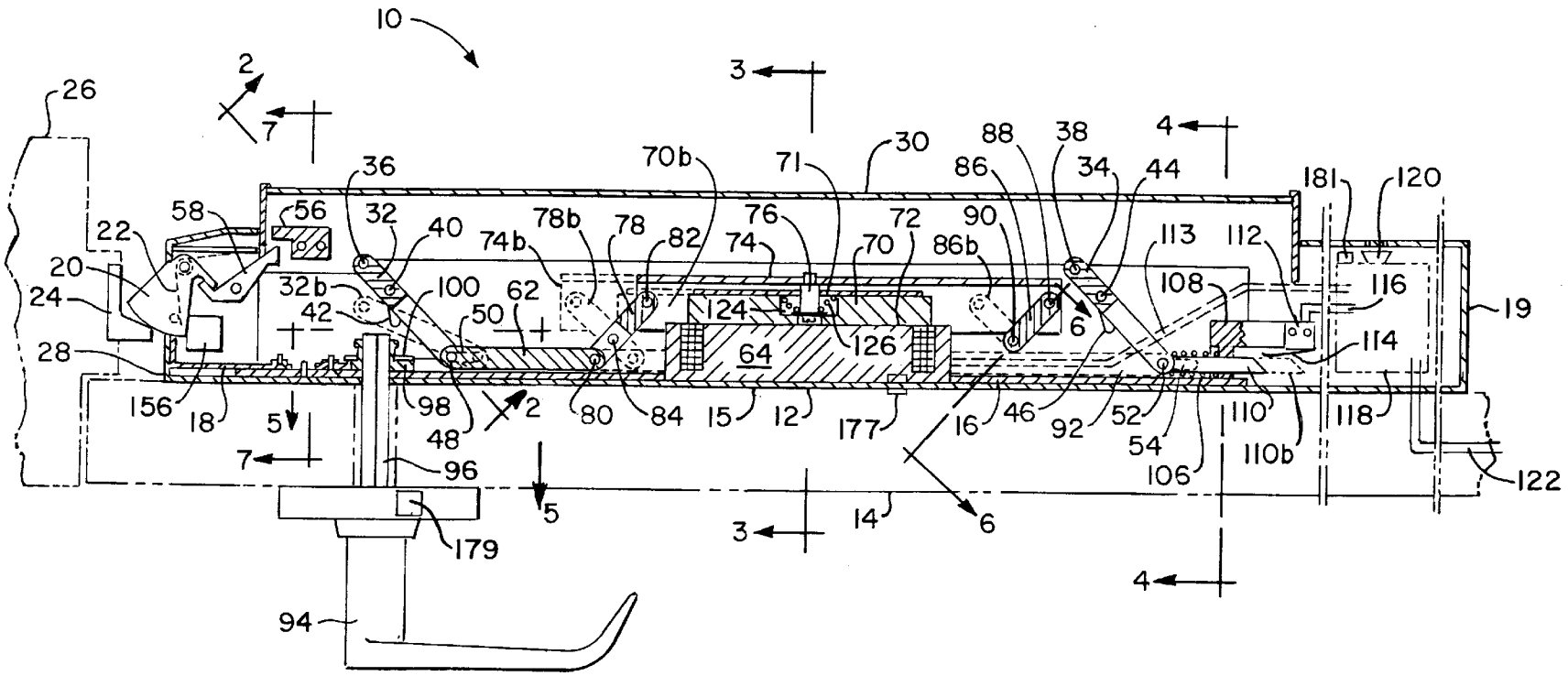
FIG. 1 is a top longitudinal sectional view, partially broken away and partially in phantom, of a preferred embodiment of the exit bar of the invention illustrated in conjunction with a door and door latch.
Figure 2:
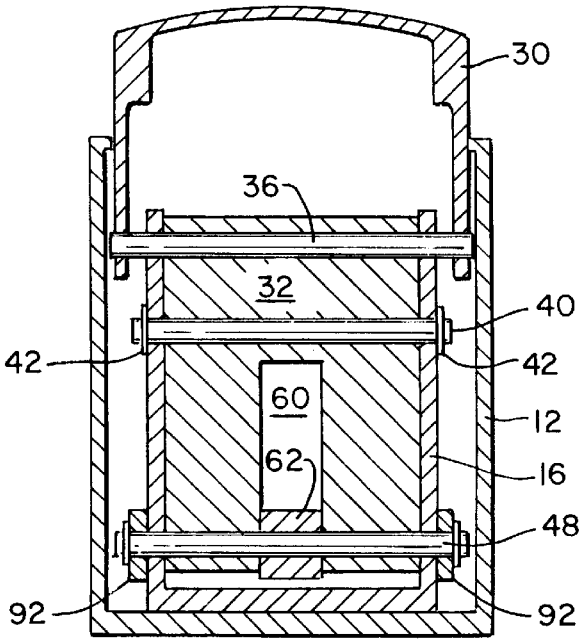
FIG. 2 is a diagonal sectional view of the exit bar of FIG. 1 taken along the line 2—2 thereof.

With reference to the drawings, wherein like numerals represent like components or structures throughout the Figures, a locking pole magnet exit bar of the invention is generally represented by the numeral 10 (see FIGS. 1–8 and 16). The exit bar 10 is mounted in a horizontal position across the interior side of a door 14 to be secured. The exit bar 10 latches against a strike mounted to the door frame from which the door 14 is supported. A push force applied at the front of the exit bar 10 retracts the latch from the strike and releases the door to open for egress. Power is supplied to the exit bar from a remote power source. The exit bar 10 is adapted to provide multiple locking, unlocking, latching and unlatching or releasing functions, and to interface with various security and alarm systems as will be detailed below.

The exit bar 10 has an elongated main housing 12 which provides the principal mounting and support structure. The length of the housing 12 is preferably sufficiently long to substantially span the width of the door 14. The main housing 12 is mounted to the door 14 by screws or other fasteners (not shown) which secure the back panel 15 of the housing in surface to surface disposition at the interior (secured) side of the door. The main housing 12 is channel-shaped with an elongated opening of the channel being spaced away from the door 14. A transversely displaceable push bar or pad 30 is located in the channel opening. The push pad defines a push face for receiving a push force exerted toward the door 14 by a person attempting to egress through the door. The push pad 30 longitudinally spans a substantial portion of the housing 12 with the housing terminating in a latch housing 18 and an opposite end enclosure 19 which is generally tubular with a rectangular cross section.

Fixed inside the main housing 12 is a main lock frame 16. The main frame 16 is also generally channel-shaped to define an opening which is also spaced away from the door. The main frame 16 is fixed to the back panel 15 of the housing 12 by screws or other mounting hardware. For purposes of describing the invention as viewed in the plane of FIG. 3, the housing 12 defines a central longitudinal axis which extends parallel to the panel 15 and a transverse axis which extends perpendicularly from the panel surface.

The exit bar 10 secures the door 14 by use of a retractable or releasable latch 20 which is pivotally mounted in the latch housing 18. Latch 20 is held in a normally extended or latched position by a latch spring 22. The latch spring urges the latch 20 to a first position against strike 24 mounted to the door frame 26. A latch cover 28 surrounds latch housing 18 to keep contaminants from the latch 20. When push pad 30 is transversely pushed into the housing 12 by a person attempting to egress, a retraction lever drive pad 56 mounted to the push pad 30 contacts a pivotally mounted latch retraction lever 58.

The retraction lever drive pad 56 pivots latch retraction lever 58 which contacts latch 20 to pivot latch 20 to a second released or unlatched position whereby the door 14 may be opened.

A push force applied to the push pad 30 is transferred through a series of links and pivots to move an armature 70 in relation to an electromagnet 64. The transverse motion of the push pad 30 is essentially translated by the links and pivots into a motion where the armature 70 swings in an arc from a position in full contact with the electromagnet 64 to a position in only partial contact with the electromagnet 64 to thereby provide various latching or locking modes as will be described below.

Push pad 30 is pivotally linked to the frame 16 for limited transverse movement therewith by a master main link 32 and a slave main link 34. The master main link 32 and slave main link 34 are pivotally connected to the push pad 30 by pins 36, 38. A master main link pin 40 extends through the master main link 32 and slidably engages in master main link pin slots 42 formed by the frame 16. In a similar construction, a slave main link pin 44 extends through the slave main link 34 and slidably engages in slave main link pin slots 46 formed by the frame 16. The master main link pin slots 42 and slave main link pin slots 46 are generally perpendicular to the face of the door 14 upon installation of the exit bar 10.

As viewed in FIG. 1, master main link 42 extends from the push pad 30 to almost the bottom of the channel of the frame 16. A second link pin 48 extends through master main link 32 and slidably engages into master main link lower slots 50 formed by frame 16. Slave main link 34 also extends to near the bottom of the channel of frame 16. A second slave main link pin 52 extends through the slave main link 34 and slidably engages in slave lower slots 54 formed by frame 16. The corresponding lower guide slots 54, 50 are oriented generally parallel to the face of the door 14 in the longitudinal direction. The construction of the master main link 32 and slave main link 34 with the associated actuation of pins and slots defines a transverse path for the push pad 30. Upon application of a push force, the transverse motion of the push pad is translated into a generally longitudinal motion at the bottoms of the master main link and slave main link due to the orientation of the lower guide slots 50, 54.

A slot 60 extends partially through master main link 32. (See FIG. 2.) A drive link 62 is located in slot 60 and pivotally connected to master main link 32 by link pin 48. Drive link 62 extends longitudinally parallel to the door face toward the end of the housing 12 opposite the latch end.

The links 32, 34, pins 36, 38, 40, 44, 48, 52, slots 42, 46, 50, 54, retraction pad 56 and lever 58 all act in concert as part of a link system to allow the push pad 30 to retract latch 20.

Within the exit bar 10, an electromagnet 64 serves to lock the bar (and hence the latch 20) by at least partially limiting the motion of the link system, and therefore preventing the push pad 30 from retracting the latch 20. The elongated E-shaped electromagnet 64 is fixedly mounted to the back panel 15 of the housing 12 and positioned to extend through an opening in the bottom of the frame 16 (as viewed in FIGS. 1—8). The electromagnet 64 is arranged longitudinally with the long axis of the electromagnet parallel to the long axis of the housing 12 and frame 16. The electromagnet 64 is preferably constructed of a series of stacked E-shaped plates 66 which act as poles of the electromagnet. An electromagnet coil 68 is positioned in the slots defined by the stack of E-shaped plates 66. The rectangular ends of the legs of the stack of plates 66 define an attractive magnetic face 72.

Figure 8:
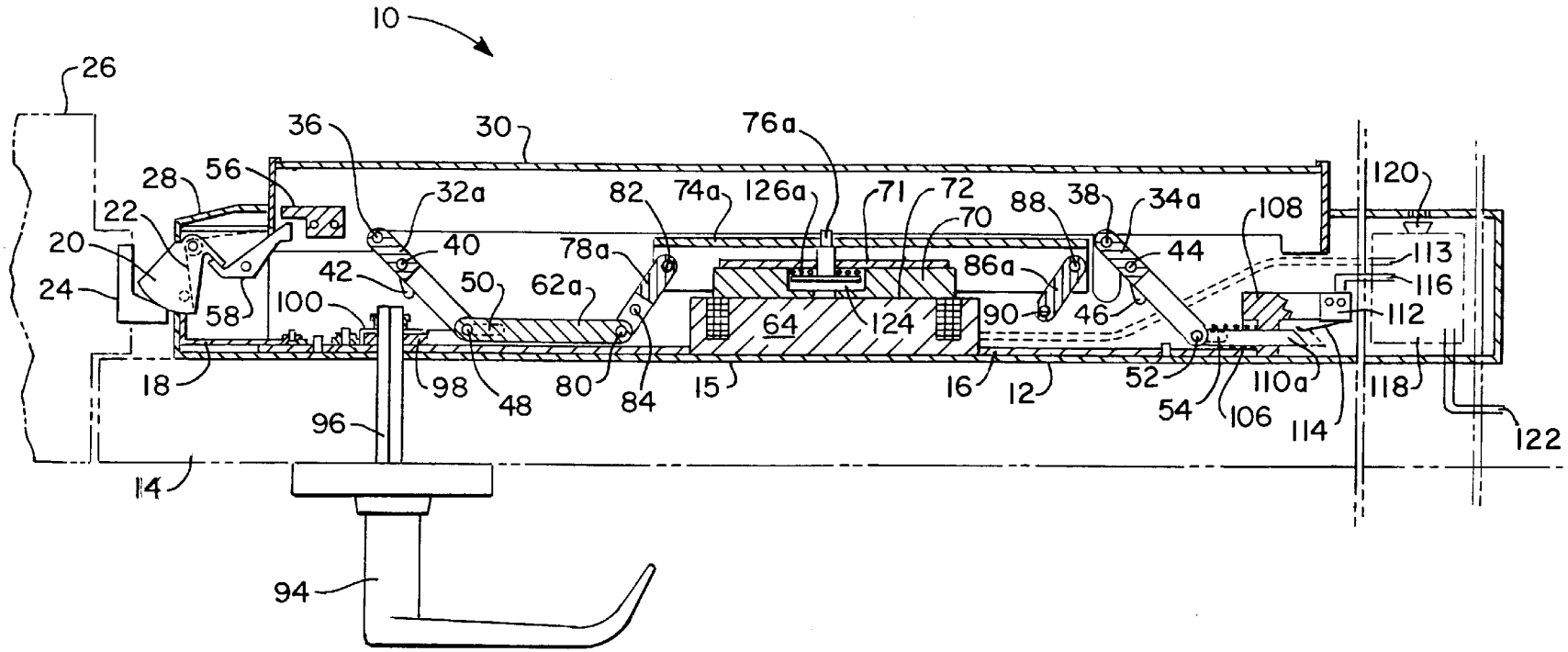
FIG. 8 is a top longitudinal sectional view, partially broken away and partially in phantom, of the preferred embodiment of the exit bar of FIG. 1 at a second operative position, illustrated in conjunction with a door and door latch.
Figure 9:
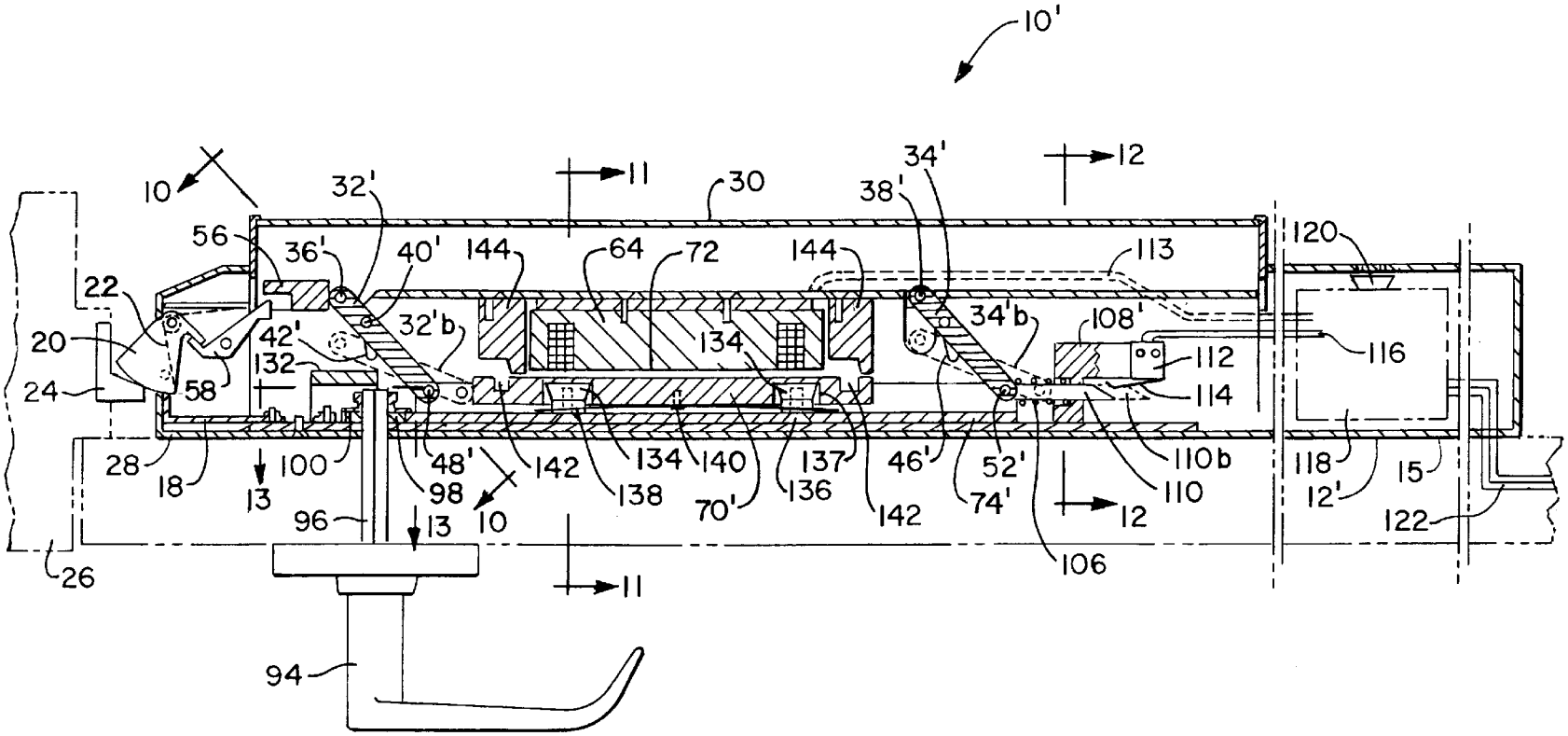
FIG. 9 is a top longitudinal sectional view, partially broken away and partially in phantom of a shear magnet embodiment of the invention, illustrated in conjunction with a door and a door latch.
Figure 10:
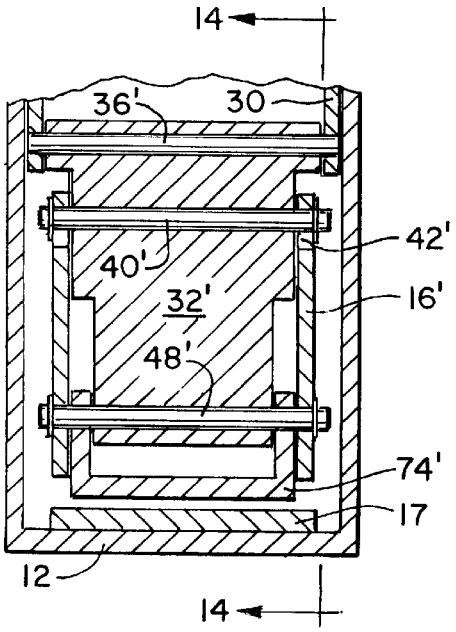
FIG. 10 is a fragmentary diagonal sectional view of the exit bar of FIG. 9 taken along the line 10—10 thereof.
Figure 11:
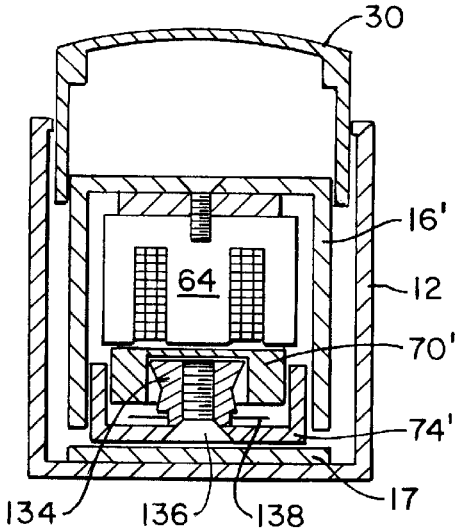
FIG. 11 is a cross sectional view, partially broken away, of the exit bar of FIG. 9 taken along the line 11—11 thereof.
Figure 12:
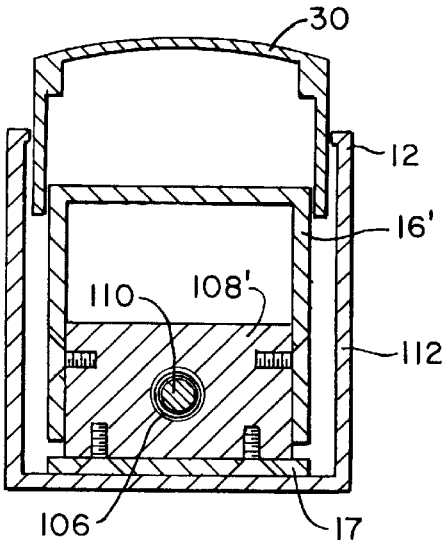
FIG. 12 is a cross sectional view of the exit bar of FIG. 9 taken along the line 12—12 thereof.
Figure 13:
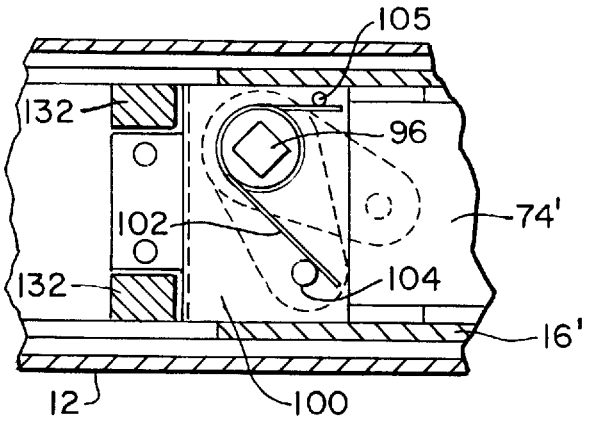
FIG. 13 is a fragmentary longitudinal sectional view, partially broken-away and partially in phantom, of the exit bar of FIG. 9 taken along the line 13—13 thereof.
Figure 14:
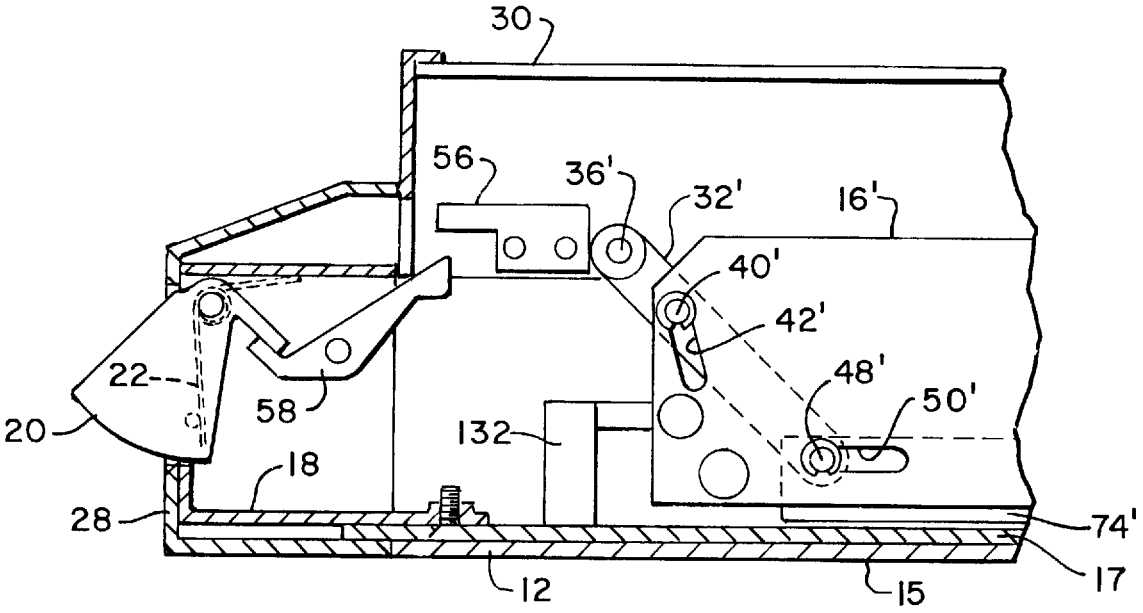
FIG. 14 is a fragmentary cross sectional view, partially brokenaway and partially in phantom, of the exit bar of FIG. 10 taken along the line 14—14 thereof.

With reference to FIGS. 1 and 8, the armature 70 and electromagnet 64 magnetically bond to lock the link system to prevent the push pad 30 from moving transversely a sufficient distance that would allow the latch 20 to be retracted.

An armature 70 is located so as to have surface to surface contact with the attractive face 72 of the electromagnet 64 when the bar 10 is in a locked state. The armature 70 is constructed of a ferromagnetic material to provide a strong bond between the electromagnet 64 and the armature 70 when the electromagnet 64 is energized. The armature 70 is mounted to an armature tray 74 by an armature suspension bolt 76 to be described later. The armature tray 74 is moveable from a position wherein the armature 70 is in full contact with the attractive face 72 of the electromagnet 64 to another position 74a (See FIG. 1) wherein the armature is in only partial contact with the attractive face 72 of the electromagnet 64.

The movement of the armature tray 74 is accomplished by use of a master auxiliary link 78 pivotally connected to drive link 62. Master auxiliary link 78 is pivotally connected at the first end to drive link 62 and at the second end to armature tray 74 by pins 80, 82, respectively. Master auxiliary link 78 pivots about a permanently positioned pivot pin 84 mounted to the frame 16. The armature tray is supported at the second end by a slave auxiliary link 86. Slave auxiliary link 86 is pivotally connected to armature tray 74 by pin 88. Slave auxiliary link 86 pivots on a permanently positioned pivot pin 90 also mounted to the frame 16.

The coordinated interaction of the link system results in the precisely managed swinging of the armature tray 74 and armature 70. Pressure on push pad 30 drives master main link 32 transversely toward the door 14. Pin 40 slides in slots 42 and pin 48 slides in slots 50 to allow the master main link to move to a second position 32*a*. Slave main link 34 slides in the respective slots to result in the same synchronized motion. Consistent and smooth transverse motion of the push pad 30 is aided by tie links 92 extending longitudinally from and connecting together pin 48 to pin 52. The tie links 92 (FIGS. 2 and 3) are located on either side of the frame 16.

The movement of master main link 32 to position 32*b* pushes drive link 62 toward the end of the housing opposite the latch end.

This causes master auxiliary link 78 to pivot on pin 84 to a second master auxiliary link position 78*b*. The pivoting of master auxiliary link 78 lifts armature tray 74 away from the electromagnet 64. The lifting of the armature tray 74 from the electromagnet 64 also causes slave auxiliary link 86 to pivot. Master auxiliary link 78 pivots to a second position 74*b* and slave auxiliary link pivots to a second position 86*b* when push pad 30 receives a push force. The armature 70 is moved in an arcuate path because of the parallelogram-like structure of the auxiliary links 78, 86, to a position 70*b* wherein only a portion of the armature is in contact with attractive face 72 of electromagnet 64.

The employment of an electromagnet 64 for the locking function provides a reliable manner of securing the exit bar 10 with a high degree of bonding integrity. The electromagnet 64 generates a strong attractive force on the armature 70 to bond the armature to electromagnet attractive face 72. Transversely pulling the armature from the energized electromagnet requires a greater force than sliding the armature longitudinally (shearing the armature from the electromagnet). The arrangement of the links and the armature tray to effect a lifting of the armature away from the attractive face 72 of the electromagnet therefore exploits an optimum bonding configuration. This configuration is referred to herein as the pole magnet arrangement.

An auxiliary handle 94 may also be provided to allow unlatching the latch 20 from the second or exterior side of the door 14. The auxiliary handle 94 located on the second side operates a spindle 96 extending through the door 14 to rotate a cam 98. (See FIGS. 1 and 5.) The cam 98 contacts the end of drive link 62 to drive the drive link when the handle 94 and spindle 96 are rotated. The armature tray 74 is therefore actuated to move in the same manner as when push pad 30 receives a pushing force and actuates movement of the armature tray 74. The cam 98 is maintained in place by use of a cam cover 100. A "torsion" coil spring 102 acts against a post on the cam 104 and a post on the cam cover 106 to maintain the handle 94 in a first position. Rotation of the handle 94 causes the lobe of the cam 98 to act on the drive link 62 and move the drive link 62 toward the end of the housing opposite the latch end. The motion of the drive link 62 by the cam 98 causes the main master link 32 and, through the communication provided by tie links 92, slave master link 34 to slide longitudinally and draw the push pad 30 transversely toward the door 14. Drawing the push pad 30 inward results in actuation of the latch 20. Push pad 30 is maintained in an extended position away from the door 14 and the links are maintained in an initial position by the bias of a main spring 106. One end of the main spring 106 acts against an anchor block 108, and the second end acts against the slave main link 34. Because of the arrangement of the described pivotal link system, the main spring 106 maintains the armature 70 in full surface to surface contact with the attractive face 72 of the electromagnet 84, even when the electromagnet 64 is not energized.

A suitable opening force applied to the push pad 30 or handle 94 activates a switch 112 to initiate the alarm and delay features of the invention. Coaxially located inside of main spring 106 is a main spring carrier 110. Main spring carrier 110 is pivotally affixed to pin 52 and extends through the anchor block 108 toward the end of the housing (right as viewed in FIG. 1). The end of the main spring carrier is beveled to contact the microswitch 112 along a switch arm 114. When push pad 30 is pushed or handle 94 is rotated through the linkages previously described, main spring carrier 110 is forced outward in the longitudinal direction toward the end of the housing opposite the latch end. This longitudinal motion causes switch arm 114 to ride on the beveled end of spring carrier 110 and therefore to activate switch 112.

Switch 112 is electrically connected via lines 116 to the lock control system 118. Activation of switch 112 generates a signal to the lock control system 118. The lock control system 118, which may assume a wide range of structures and provide for numerous optional capabilities, generally controls the energizing of the electromagnet 64 and other alarm or control features of the security system provided by the invention. The lock control system 118 controls the energizing and deenergizing of the electromagnet by selectively controlling the power transmission to the electromagnet over lines 113. In one possible embodiment of the invention, activation of switch 112 can activate an audible and/or visible alarm 120 located in the housing 12. The alarm signal generated directly can be at the location of the exit bar and/or can be transmitted over lines 122 to a remote monitoring location to indicate that a door opening has been attempted. The lock control system 118 and electromagnet 64 are powered over the multi-stranded cable that comprises the lines 122. In the preferred embodiment, the lock control system 118 embodies a delay feature to delay deenergizing the electromagnet 64 for a preestablished period of time after the switch 112 has been activated.

Figure 3:
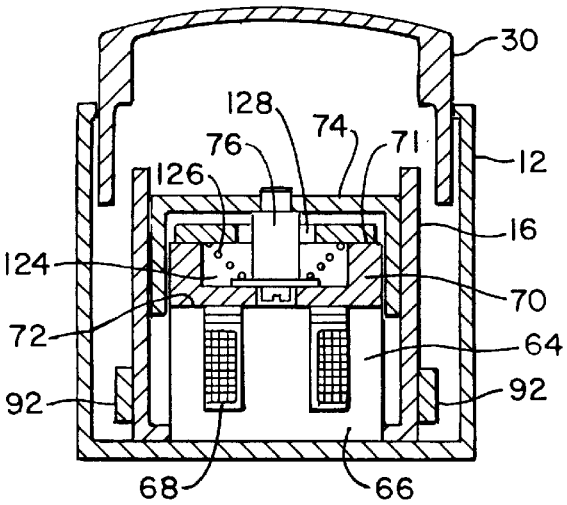
FIG. 3 is a cross sectional view, partially broken away, of the exit bar of FIG. 1 taken along the line 3—3 thereof.
Figure 4:
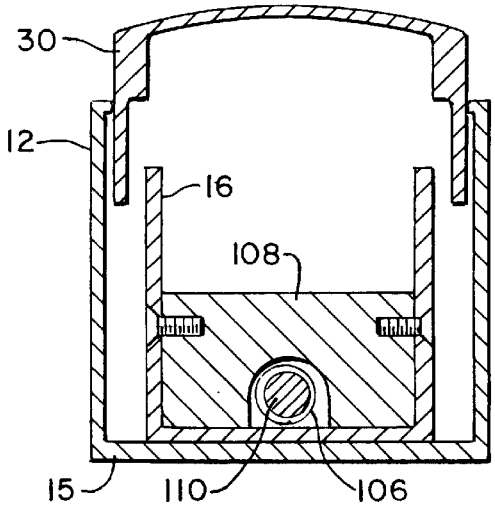
FIG. 4 is a cross sectional view of the exit bar of FIG. 1 taken along the line 4—4 thereof.
Figure 5:
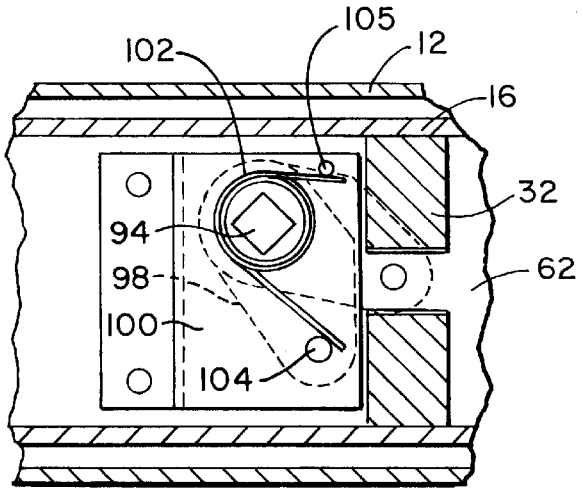
FIG. 5 is a fragmentary longitudinal sectional view, partially in phantom, of the exit bar of FIG. 1 taken along the line 5—5 thereof.
Figure 6:
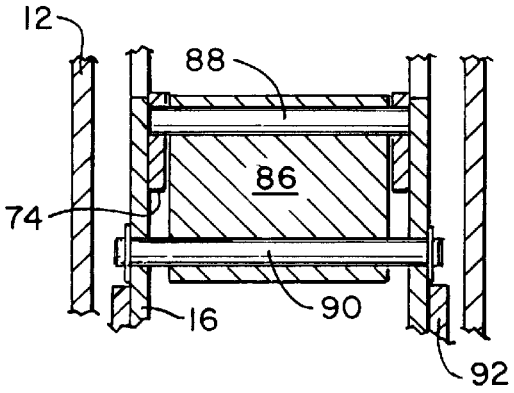
FIG. 6 is a fragmentary cross sectional view, partially broken away, of the exit bar of FIG. 1 taken along the line 6—6 thereof.
Figure 7:
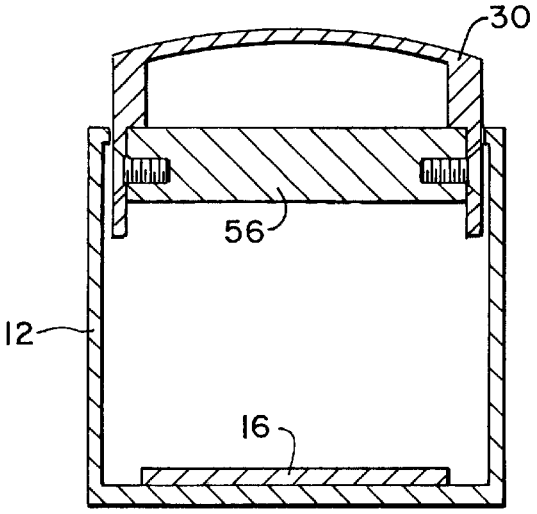
FIG. 7 is a cross sectional view of the exit bar of FIG. 1 taken along the line 7—7 thereof.

For embodiments of the invention which employ a delay egress feature, the armature suspension bolt 76 does not rigidly fix the armature 70 to the armature tray 74. With reference to FIGS. 1 and 3, the armature 70 and an armature top plate 71 define armature cavity 124 therebetween. The armature bolt 76 and an armature spring 126 surrounding the armature bolt 76 are located in the armature cavity 124. The armature spring 126 exerts an expansion force between a bottom expanded washer like portion of armature bolt 76 and the armature top plate 71. The armature top plate 71 additionally defines a longitudinal slot 128 through which the upper portion of the armature bolt 76 passes. The upper portion of the armature bolt 76 is rigidly fixed to armature tray 74. The configuration of the armature bolt assembly thus allows the armature tray 74 to partially lift away from the armature 70 even while the armature 70 is rigidly bonded to the energized electromagnet 64. As can be observed by reference to FIG. 8, the armature spring 126 is compressed between the armature top plate 71 and the expanded portion of the armature bolt 76 as the armature tray 74 is lifted away from the armature 70.

The armature tray 74 is initially limited in movement because the expanded portion of the bolt 76 is greater in diameter than the width of the slot 128. This constrained movement allows, through the corresponding actuation of the associated pins and links, for main spring carrier 110 to move a sufficient distance longitudinally to a position 110*a* to allow microswitch 112 to be activated and thereby signal the lock control system 118 (see FIG. 8). The slot 128, however, is relatively short in length so the armature tray 74 cannot move a sufficient amount relative to the armature 70 to actually allow the retraction lever drive pad 56 to contact the latch retraction lever 58 and to thereby retract latch 20.

Once the switch 112 has been activated, an interval timer of the lock control system 118 counts down a preselected time before de-energizing electromagnet 64. Should the switch 112 be constantly activated by spring carrier 110, the electronics 118 can signal to a remote monitoring station 152 over lines 122 that the exit bar 10 is held or has jammed in an open position thereby indicating a need for maintenance or attention.

During periods of high traffic use, it may be advantageous to dog the exit bar 10 in an unlatched or released position. Dogging the latch 20 reduces wear and tear on the latch mechanism and speeds ingress and egress through the doorway. When the dogging feature is selected, push pad 30 is pushed inward to allow armature tray 74 to be in position 74*b*. The electromagnet may then be energized to hold the pad 30 and latch 20 in a dogged or unlatched position. The push pad 30 remains retracted into the housing while the latch 20 is dogged. The dogging feature may be accomplished by a signal from the remote site over lines 122 in combination with a push force applied to the push pad 30. The lock control system 118 can thus be instructed to dog the latch on the next door opening. The lock control system 118 recognizes when the armature is in partial contact with the attractive face and reenergizes the electromagnet 64 to bond the armature.

Figure 16:
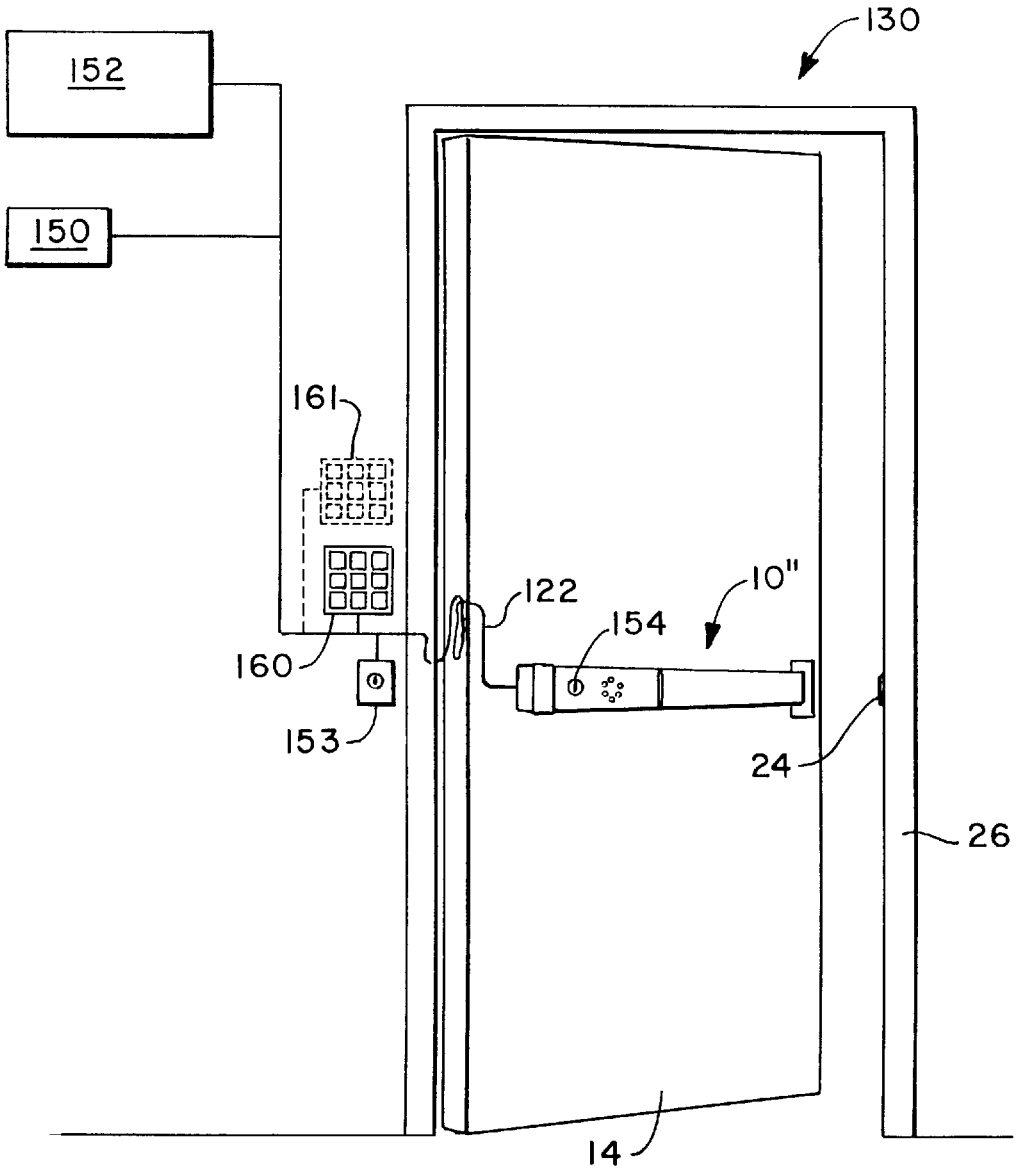
FIG. 16 is a schematic view of an alternative configuration of the preferred embodiment of the invention mounted to the door and illustrating various auxiliary features thereof.

With reference to FIG. 16, a key switch 153 at the door site 130, or a key switch 154 on an exit bar 10", may also be used to release and reenergize the electromagnet to allow dogging. Exit bar 10", which is similar in form and function to the preferred embodiment pole magnet exit bar 10, further includes the key switch 154. The exit bars 10, 10' may each be undogged from a remote location by signalling lock control system 118 to deenergize the magnet so as to allow the main spring to reset the exit bar. Undogging can also be accomplished at the site of the door by the key switch 154 or by the key switch 153 acting over lines 122.

The linkage system of the exit bar 10 of the invention has three discrete internal positions to provide a delayed unlocking feature. In the first position, the armature 70 is in substantially full contact with the energized electromagnet 64. (See FIG. 1.) This is the normally locked position. Pushing on the push pad 30 or rotating the auxiliary handle 94 transforms the link system to a second position. In the second position (see FIG. 8), the armature 70 is still in full contact with the energized electromagnet 64. The system has sufficient "play" or "flexibility" in the second position through the spring loaded armature suspension bolt 76, to allow the armature tray 74 to begin transverse lifting away from the armature 70. This constrained transverse lift allows the switch to be activated by the spring carrier 110 to begin a delay sequence, activate an alarm, etc. The links, armature, armature tray and other components are designated in the second position by an "a" following the numerical identifier 32*a*, 34*a*, 62*a*, 74*a*, 76*a*, 78*a*, 86*a*, 110*a* and 126*a*.

As the link system moves the armature assembly, comprising the armature tray 74 and armature 70, from the second to the third position of the link system the electromagnet 64 is de-energized and the armature 70 swings away from the electromagnet 64 to position 74*b*. (See FIG. 1.) When the link system is in the third position, the push pad 30 is pushed transversely toward the door 14 or the handle 94 rotated, to actuate the latch 20. The links, armature and other components are designated in the third position by a "b" following the numerical identifier 32*b*, 70*b*, 74*b*, 78*b*, 86*b* and 110*b*. The dogging feature is activated when the link system in the third position. The armature is held in partial contact with the energized electromagnet 64 to maintain the latch 20 in an unlatched or released state.

With reference to a second embodiment of the invention employing a sliding armature or shear lock configuration shown in FIGS. 9–15, the exit bar 10' has substantially the same structure, and operates in substantially the same manner as that of the preferred embodiment exit bar 10 except for the differences and features described below.

The main lock frame 16' of the sliding armature embodiment of the invention 10' is a generally longitudinal U-shaped channel with its open side oriented toward the door 14 to which the exit bar 10' is mounted. The frame 16' is held in the housing 12 in a spaced apart relation away from a lower frame support 17 and the back panel 15 of the housing 12 by use of an anchor block 108' and a bolt block 132. The frame 16' is mounted to the bolt block 132 and anchor block 108' by machine screws. The electromagnet 64 is mounted to the bottom of the channel of frame 16' with the attractive face 72 of the electromagnet 64 oriented toward the door 14.

The push pad 30 is pivotally mounted to master main link 32' and slave main link 34', and operates in the same general manner as that of exit bar 10. The second link pins 48' and 52', however, are pivotally linked to the armature tray 74'. Exerting a transverse force toward the door 14 on the push pad 30, or rotating handle 94 to operate cam 98, results in longitudinal displacement of the armature tray 74' toward the end of the housing opposite the latch end.

A significant difference in construction between exit bar 10' and exit bar 10 is the arrangement, position and motion of the armature 70'. The armature 70' of the shear lock exit bar 10' is constructed to slide across the attractive face 72 of the electromagnet 64, as compared to the swinging arcuate motion of pole magnet exit bar 10.

Armature 70' is mounted to the armature tray 74' by armature posts 134. The armature posts 134 are secured to the armature tray by machine screws 136. The armature posts 134 rest in recesses 137 located in the back of the armature 70', opposite the side of the armature 70' attracted to the electromagnet 64. The armature posts 134 fit into the recesses 137 of the armature 70' in such a manner as to allow the armature 70' to move transversely to the face of the door while the armature tray 74' remains fixed in the same transverse direction. The armature posts 134 do, however, resist shear motion in the longitudinal direction along the axis of the exit bar. An armature leaf spring 138 is secured to the armature 70' by an armature spring screw 140. The armature spring 138 acts against the bottom of the armature posts 134 to hold the armature 70' in a spaced apart relation from the attractive face 72 of the electromagnet 64 when the electromagnet 64 is not energized.

Figure 15:
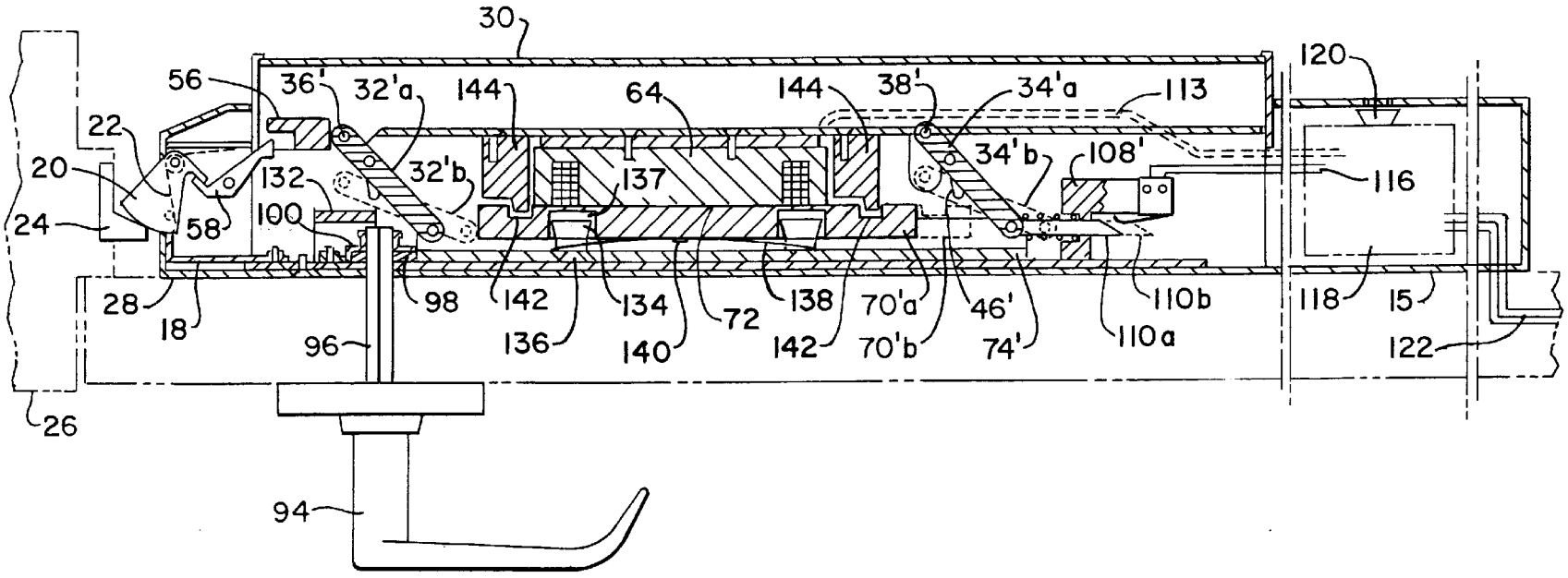
FIG. 15 is a top longitudinal sectional view partially broken away and partially in phantom, of the shear lock embodiment of the invention partially engaged and illustrated in conjunction with a door and door latch.

With reference to FIG. 15, when the electromagnet 64 is energized, sufficient electromagnetic attractive force is created between the electromagnet 64 and armature 70' to overcome the force of the armature leaf spring 138 and move the armature 70' transversely toward the electromagnet 64. This motion allows the armature 70' to obtain surface to surface contact with the attractive face 72, thereby locking the exit bar 10'. When armature 70' is attracted to electromagnet 64, armature tray 74' is held in a fixed longitudinal position. Therefore, latch retraction is prevented by not permitting the lever drive pad 56 to contact the latch retraction lever 58 to rotate latch 20. Armature 70' further has two engagement slots 142 for receptive engagement by lock dogs 144 which are mounted to frame 16'. Lock dogs 144 extend transversely beyond the attractive face 72 of the electromagnet 64. When armature 70' is held in electromagnetic engagement with the electromagnet 64, lock dogs 144 extend into engagement slots 142 which provide additional resistance to longitudinal shear forces generated by pressing the push pad 30 or rotating the handle 94. The lock dogs 144 and engagement slots 142 help prevent forced unlocking of the exit bar 10' by a large shear force generated by, for example, a kick on the push pad 30.

The exit bar 10' can also be operated from the second side of the door by a handle 94. The handle 94, by action of the spindle 96, operates the lock in much the same manner as in the preferred embodiment pole magnet exit bar 10. The cam 98, mounted to the spindle 96 directly contacts the armature tray 74'. Therefore, when the handle 94 and spindle 96 rotate, the cam 98 drives the armature tray 74' longitudinally to activate the latch 20 through the link system.

The sliding armature embodiment 10' may also be used in a delayed egress mode. In the delayed egress configuration, the armature 70' is held initially in a position closer to the latch end of the housing 12. The electromagnet 64 is energized and the armature 70' is drawn towards the attractive face 72. The armature 70' therefore rests upon the top surfaces of the lock dogs 144. When the armature 70' is so positioned, a gap exists between the armature 70' and the electromagnet 64 because the lock dogs 144 extend above the electromagnet attractive face 72. This gap between the armature 70' and attractive face 72 reduces the attractive force and allows the armature 70' to be displaced along the longitudinal axis by a shear force even while the electromagnet 64 is energized.

When the push pad 30 is pushed or the handle 94 is rotated, the action causes the armature 70' to translate along the longitudinal axis toward the end of the exit bar opposite the latch. As the armature 70' moves in this direction, the dogs 144 and the engagement slots 142 come into alignment and the armature 70' is pulled by the energized electromagnet into full surface to surface contact with the attractive face 72 of the electromagnet 64. The contact between the armature 70' and electromagnet 64 and the engagement of the lock dogs 144 in the slots 142 stop any further longitudinal movement and provides a strong locking engagement. The longitudinal movement of the armature 70' from a position on top of the lock dogs 144 to where the lock dogs 144 engage the engagement slots 142 is sufficient to allow the main spring carrier 110 to move sufficiently longitudinally to actuate the microswitch 112. (See FIG. 15.) The switch actuation signals the lock control system 118 to begin counting the preestablished delayed unlock time interval.

When the armature 70' is in full bonded engagement with the attractive face 72 and the dogs 144 are positioned in the engagement slots 142, the armature tray 74' is highly resistant to movement in the longitudinal direction. When the lock control system 118 deenergizes the electromagnet 64, the armature spring 138 retracts the armature 70' from the lock dogs 144. The armature 70' can then be moved longitudinally toward the end of the exit bar opposite the latch wherein additional pushing on the push pad 30 or rotation of the handle 94 allows the latch 20 to be retracted or released from the strike 24.

The sliding armature embodiment 10' may also be used to dog the latch 20 so as to reduce wear of components and allow easier ingress and egress through the doorway. The dogging is accomplished by transversely depressing the push pad 30 to move the armature 70' to the maximum displaced position 70'*b* toward the end of the exit bar opposite the latch end. Next, the magnet 64 is energized by a key switch 154 or from a remote monitoring station 152. The armature 70' will bond to the electromagnet 64, preventing the link system from returning to the initial position of the system. In the dogged position of the armature 70'*b*, the lock dogs 144 are not engaged into the engagement slots 142 and the armature tray 74' is held in a fixed longitudinal position due to the frictional engagement between the armature 70' and the top surface of the lock dogs 144 in combination with the electromagnetic attraction.

Similar to the preferred embodiment of the exit bar 10, the sliding armature exit bar 10' also operates in a three position sequence for the armature/link system for a delayed unlocking application. In the first position, the armature 70' is held in an initial position by the energized electromagnet 64 wherein the armature 70' rests on top of the ends of the lock dogs 144. A gap therefore exists between the attractive face 72 of the electromagnet 64 and the armature 70'. Rotation of the handle 94 or pushing of the push pad 30 moves the armature 70' along the longitudinal axis to a position 70'*a* where the armature 70' is in full surface to surface contact with the attractive face 72 of the electromagnet 64.

In the second position, the lock dogs 144 are positioned in the engagement slots 142 of the armature 70'. Also, in this second position, the switch 112 is actuated and signals the lock control system 118 to begin the delay sequence. The push pad 30 cannot move inwardly sufficiently far to actuate the latch 20 when the armature 70' is in the second position. The links and other components are designated in the second position by an "a" following the numerical identifier, e.g., 32'*a*, 34'*a*, 70'*a*, 110*a*.

When the electromagnet 64 is deenergized, the armature 70' can be moved to a third position. In the third position, the push pad 30 can be pushed sufficiently far transversely toward the door face, or the handle 94 rotated sufficiently far, to actuate the latch 20. The links, armature 70' and other components are designated in the third position by a "b" following the numerical identifier, 32'*b*, 34'*b*, 70'*b*, 110'*b*.

In a manner similar to that of the preferred embodiment, dogging is implemented by energizing the electromagnet 64 when the link system is in the third position thereby maintaining the push pad 30 in a position recessed into the housing 12 while the latch 20 is released or retracted.

With reference in particular to FIG. 16, the exit bar 10" is mounted to a door 14 supported in a door frame 26. The exit bar 10" is preferably supplied with electricity from a remote power supply 150 over lines 122 in a conventional manner.

The exit bars of the invention are readily adaptable for communication with a remote security system 152. The remote security system 152, which may also incorporate fire safety features, can be used to securely lock or unlock the exit bar and receive alarm information with regard to attempted egress or ingress through the doorway. The remote system can further control dogging or undogging of the exit bar. The exit bars of the invention can also be integrated into a complete security system wherein exit through the doorway without activation of an alarm can only be accomplished by use of a valid input in an electronic access device 160, such as a card reader or touch pad, at the location of the doorway. An additional electronic reader device 161 can be provided at the second side or exterior of the door 14 for the same purpose.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An exit bar for mounting to a door face, said exit bar comprising:

a housing adapted for mounting to a door face;

a push pad mounted to said housing, said push pad defining an exposed push face for receiving a push force;

latch means extending from said housing for releasably latching a door;

link means for linking said pad to said latch means to release said latch means when said pad is pushed; and lock means disposed in said housing for locking said link means, said lock means comprising electromagnet means and armature means for electromagnetic bonding to said electromagnet means to lock said link means.

2. The exit bar of claim 1 further comprising handle means mountable on a second face of said door for releasing said latch means.

3. The exit bar of claim 1 wherein said lock means is transformable between a locked and an unlocked state and further comprising delay means for delaying transforming said lock means to an unlocked state for a preestablished delay time interval after said pad is pushed.

4. The exit bar of claim 3 wherein said delay means comprises switch means activated by said link means to begin said delay time interval.

5. The exit bar of claim 1 wherein said link means moves said armature means along a generally arcuate path.

6. The exit bar of claim 1 wherein said lock means further comprises lock dog means for engaging said armature means to resist a shear force between said electromagnet means and said armature means.

7. The exit bar of claim 1 wherein said link means further comprises a yieldable armature bolt means connecting said armature means and said link means.

8. The exit bar of claim 4 wherein said electromagnet means and said armature means electromagnetically bond to support said latch means in a dogged position.

9. The exit bar of claim 1 wherein said electromagnet means and said armature means electromagnetically bond to support said latch means in a dogged position.

10. An exit bar for mounting to a door face comprising:

a housing adapted for mounting to a door face;

a push pad mounted to said housing, said push pad defining a push face for receiving a push force;

latch means extending from said housing for releasably latching a door;

link means for linking said pad to said latch means so as to release said latch means when said pad is pushed; and electromagnetic lock means disposed in said housing for electromagnetically locking said link means and for dogging said latch means in a released position, said lock means comprising an electromagnet.

11. The exit bar of claim 10 further comprising control means for controlling energizing and de-energizing of said electromagnet.

12. The exit bar of claim 10 wherein said electromagnetic lock means further comprises an armature for electromagnetic bonding to said electromagnet.

13. The exit bar of claim 12 wherein said link means are connected to said armature, and wherein said link means hold said armature in a first position when said link means is locked, and hold said armature in a second position when said latch means is released.

14. The exit bar of claim 13 wherein said electromagnet lock means dog said latch means by energizing said electromagnet when said armature is in said second position.

15. The exit bar of claim 10 comprising delay means for delaying releasing said latch means for a pre-established time interval after said push pad is pushed.

16. The exit bar of claim 15 wherein the delay means comprises switch means activated by said link means to begin said pre-established time interval.

17. The exit bar of claim 10 further comprising alarm means for initiating an alarm when said push pad is pushed.

18. The exit bar of claim 12 wherein said armature moves in an arcuate path as said latch means moves from an unreleased state to a released state.

19. An exit bar for securing a door, said exit bar comprising:

a housing adapted for mounting to a door face;

a push pad mounted to said housing, said push pad defining an exposed push face;

latch means extending from said housing for releasably latching a door;

link means for linking said pad to said latch means so as to release said latch means when said push pad is pushed;

lock means disposed in said housing for locking said link means, said lock means comprising an electromagnet and an armature, wherein one of said electromagnet and said armature is fixed relative to said housing and the other is mounted in relation to the link means to provide locking of said link means.

20. The exit bar of claim 19 wherein said electromagnet is fixed relative to said housing.

21. The exit bar of claim 20 wherein said armature moves in an arcuate path as said latch means is released.

22. The exit bar of claim 20 wherein said armature moves in a substantially linear path as said latch means is released.

23. The exit bar of claim 19 further comprising delay means for delaying releasing said latch means for a preestablished time interval after said push pad is pushed.

24. The exit bar of claim 23 wherein said delay means comprises switch means for initiating said preestablished time interval.

25. The exit bar of claim 19 further comprising alarm means for initiating an alarm when a push force is exerted against said push pad.

26. The exit bar of claim 19 wherein said latch means is dogged by electromagnetically bonding said armature to said electromagnet.

27. An exit bar for securing a door, said bar comprising a housing adapted for mounting to a door face;

a push pad mounted to said housing, said push pad defining a push face for receiving a push force;

latch means extending from said housing for releasably latching a door;

link means for linking said push pad to said latch means wherein when said push pad is pushed, said latch releases;

lock means for locking said link means, said lock means comprising an electromagnet means and an armature means for bonding to said electromagnet means; and switch means for generating a signal when said push pad is pushed, said link means supporting said armature means in a first position wherein said link means is locked when said electromagnet means is energized, said armature means being movable to a second position when a push force is exerted against said push pad, said switch means generating a signal at said second position and said link means being locked when said electromagnet is energized at said second position and said armature means being movable to a third position wherein said latch means is released.

28. The exit bar of claim 27 wherein said latch means is dogged by energizing said electromagnet means when said link means supports said armature means in said third position.

29. The exit bar of claim 27 further comprising a delay means for delaying releasing said latch means for a preestablished time interval after said signal is generated.

30. The exit bar of claim 27 wherein said armature means contacts said electromagnet means in said first and said second positions.

31. The exit bar of claim 27 wherein said armature means defines an arcuate path as said armature means moves from said first to said third position.

32. The exit bar of claim 27 wherein as said armature means moves from said first position to said second position, said armature means moves across said electromagnet means.

33. The exit bar of claim 32 further comprising lock dogs, and said armature means defines engagement recesses, said lock dogs projecting into said engagement recesses when said armature means is in said second position.

34. The exit bar of claim 27 further comprising main spring means for biasing said link means to supporting said armature means in said first position.

* * * * *